United States Patent [19]

Nelson

[11] Patent Number: 4,951,532

[45] Date of Patent: Aug. 28, 1990

[54] TOE-IN TOOL

[76] Inventor: Shelby W. Nelson, 170 - 15th Ave., NE., Minneapolis, Minn. 55413

[21] Appl. No.: 479,283

[22] Filed: Feb. 13, 1990

[51] Int. Cl.[5] ..... B25C 3/00

[52] U.S. Cl. ..... 81/44

[58] Field of Search ..... 81/44, 487, 23; 227/147

[56] References Cited

U.S. PATENT DOCUMENTS

| | | | |
|---|---|---|---|
| 2,799,860 | 7/1957 | Myers | 81/44 |
| 4,037,632 | 7/1977 | Arena | 81/44 |
| 4,079,765 | 3/1978 | Hatayan | 81/44 |

*Primary Examiner*—D. S. Meislin

[57] ABSTRACT

A nail holding and positioning tool includes an elongate handle and a sectional head having the configuration of a 45-degree right triangle. The sectional head includes a central section and pair of outer sections normally abutting the central section. The sectional head is provided with a pair of openings which extend along the parting lines between the central section and each outer section. The handle includes a central handle element and a pair of outer handle elements, each being secured to one of the sections of the sectional head. When a conventional nail is positioned within an opening in the head and the head is positioned in engaging relation with a stud joint, the nail will be disposed at the correct toe-in angle. After the nail is partially driven into the stud joint, the tool may be removed from engaging relation with the nail by simply shifting an outer head section laterally with a handle element.

6 Claims, 1 Drawing Sheet

TOE-IN TOOL

FIELD OF THE INVENTION

This invention relates to a carpentry tool and, more particularly, to a nail holding and positioning tool.

BACKGROUND OF THE INVENTION

During the construction of various building structures, right angular stud joints are secured together by nails driven at approximately a 45-degree angle with respect to one of the stud surfaces. Approximately 60% of the length of the toe-in nails penetrates one of the studs, and approximately 40% of each nail length penetrates the other stud. The accuracy and effectiveness of making right angular stud joints depends, of course, on the ability of a carpenter. In some instances, the nails are not driven into the stud joint at the desired toe-in angle. In other instances, the carpenter or workman inadvertently strikes his finger or thumb with a hammer. Applicant is unaware of any nail holding tools which correctly position the nail at the desired toe-in angle, and which may be readily removed from the nail after the nail has been partially driven into the right angle stud joint.

SUMMARY OF THE INVENTION

It is an object of this invention to provide a novel held-hand holding tool, of simple and inexpensive construction, which accurately holds and positions a nail at the correct toe-in angle, but which permits the tool to be removed from the nail after the nail has been partially driven into the joint.

A more specific object of this invention is to provide a nail holding tool, including a handle and a head, the latter having the configuration of a right triangle with openings therethrough for accurately positioning and holding the nails at the correct toe-in angle.

In carrying out the invention, the nail holding tool includes a sectional, triangular-shaped head having a handle secured thereto. The head of the nail holding tool is in the shape of a 45-degree right triangle and includes a central section and a pair of outer sections. The central section and the outer sections are defined by parting lines, which also define confronting surfaces. These confronting surfaces have grooves therein, which define openings for accommodating the nails. The handle includes a central handle element and a pair of outer handle elements, the latter being secured to the outer head sections. By manipulating an outer handle element, an outer head section may be moved laterally relative to the central section to permit the tool to be removed from a nail after the latter has been partially driven into the stud joint.

FIGURES OF THE DRAWING

DESCRIPTION OF THE PREFERRED EMBODIMENT

Figure 1:
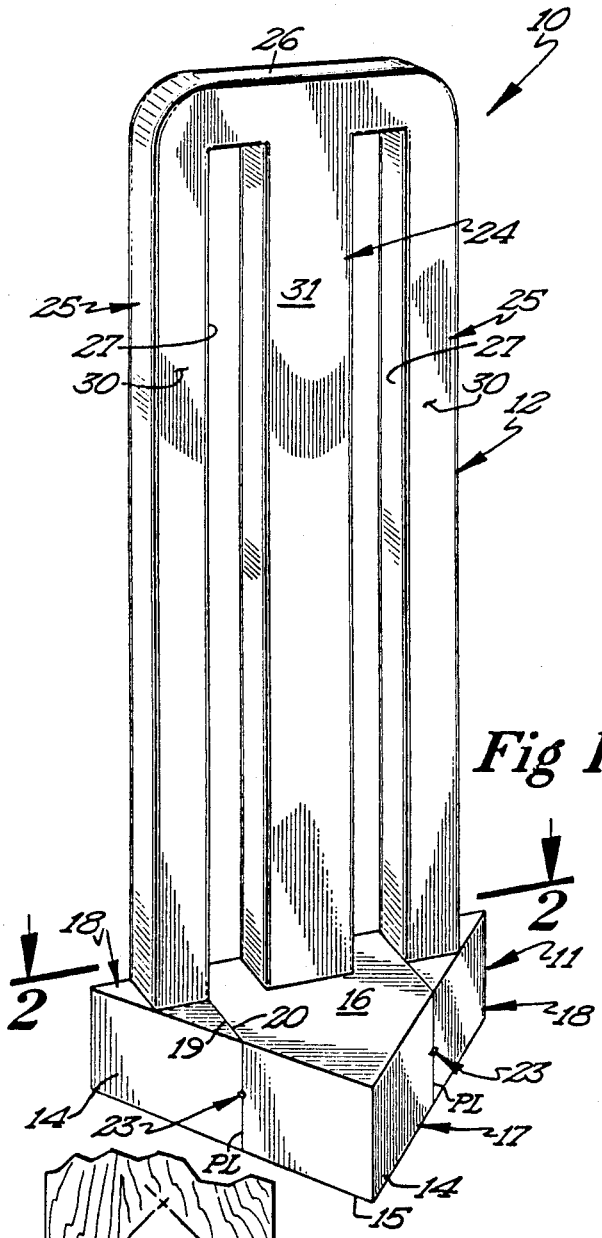
FIG. 1 is a perspective view of the novel nail holding tool, illustrating a nail extending through one of the nail openings therein.

Referring now to the drawings and, more specifically, to FIG. 1, it will be seen that one embodiment of the novel nail holder and toe-in tool, designated generally by the reference numeral 10, is thereshown. The tool 10 includes a sectional triangular-shaped head 11 and an elongate handle 12 secured to the head and projecting therefrom. The tool 10 may be formed of any suitable rigid material, preferably a plastic, such as high strength Polyethylene, and formed in a molding operation.

The sectional head 11 has a flat upper edge or base surface 13 and a pair of flat inclined leg surfaces 14. The sectional head also includes a flat planar front surface 15 and a flat planar rear surface 16. The sectional head 11 is in the form of a 45-degree right triangle and the included apex angle A between the leg surfaces 14 is 90 degrees, while the base angles B between each leg surface and the base surface is 45 degrees.

Figure 2:
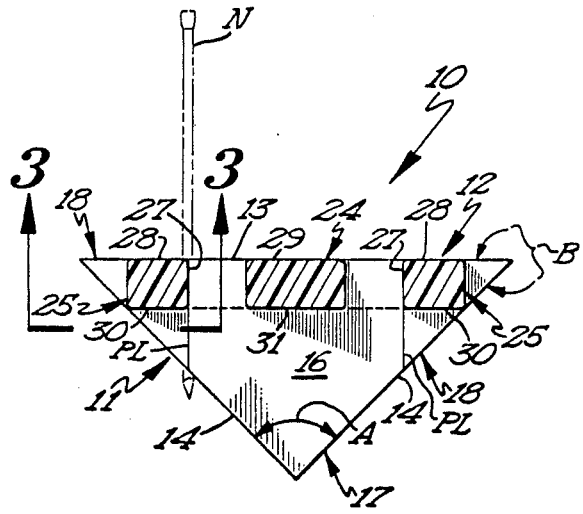
FIG. 2 is a cross-sectional view taken approximately along the line 2—2 of FIG. 1 and looking in the direction of the arrows.

The sectional head 11 includes a central section 17 and a pair of outer sections 18, as best seen in FIGS. 1 and 2. These sections are defined by a pair of parting lines PL in the sectional head, and these parting lines are disposed in substantially parallel spaced apart relation, as best seen in FIGS. 1 and 2.

The parting lines PL each define a substantially flat outer surface 19 of the central section 17 and a confronting matching flat inner surface 20 of each outer section 18. It will be seen that the central section 17 includes a portion of the leg surfaces 14 and the central portion of the base surface 13. Each outer section 18 also includes a portion of each leg surface 14 and the outer portion of the base surface 13. In the embodiment shown, each parting line PL bisects one of the leg surfaces 14 so that the inner surface 20 of each outer section has a length dimension corresponding to that portion of the associated leg surface which forms a side of the outer section. Thus, each outer section 18 also constitutes a 45-degree right triangle.

Figure 3:
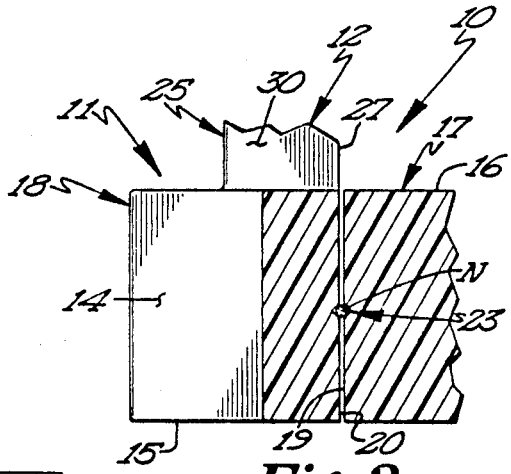
FIG. 3 is a fragmentary elevational view of a portion of the tool taken along the cutting plane defined by line 3—3 of FIG. 2 and looking in the direction of the arrows.
Figure 5:
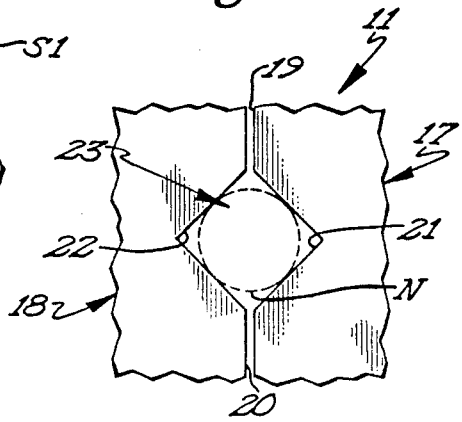
FIG. 5 is a fragmentary elevational view similar to FIG. 3 illustrating details of construction of the novel tool.

Referring now to FIGS. 3 and 5, it will be seen that each outer surface 19 of the central section 17 has an elongate V-shaped groove 21 therein. Similarly, the inner surface 20 of each outer section 18 also has a V-shaped groove 22 therein, which is disposed in opposed confronting relation with respect to the associated groove 21 in the central section. Each groove 21 cooperates with a groove 22 to define an opening 23 through the head along the associated parting line PL. It will be noted that the opening 23 has a square or diamond-shaped configuration, which is defined by each side of a groove, each groove side being 1/32 of an inch in magnitude. It will also be seen that the axis of each opening 23 is perpendicular or normal to the base surface of the triangular head 11. Each opening 23 is of a size to accommodate a conventional size nail therethrough, such as a conventional commercial 8-penny or 10-penny nail. It will be appreciated that 8-penny nails are used extensively in carpentry, cabinet making, and the like.

The handle 12 is comprised of an elongate central handle element 24 which is rigidly or integrally formed at one end thereof with the central head section 17. The handle 12 also includes a pair of outer handle elements 25, each being rigidly secured to one of the outer head sections 18. It will be noted that the handle elements are disposed in substantially spaced apart parallel relation with respect to each other and are rigidly interconnected at their rear ends by a rear transverse connecting portion 26. In the embodiment shown, the central handle section 24 is of rectangular cross-sectional configuration, while the outer handle elements 25 are of square cross-sectional configuration, as best seen in FIG. 2.

It will be noted that the inner surface 27 of each outer handle element 25 is disposed in substantially coplanar relation with a parting line PL. It will also be noted that the upper surface 28 of each outer handle element 25 is disposed substantially coplanar and coextensively with the flat base surface 13. Similarly, the upper surface 29 of the central handle element 24 is also disposed coplanar with the base surface 13. With this arrangement, the base surface 13 of the sectional head 11 and the upper surfaces of the central and outer handle elements will engage a flat surface when the tool is so disposed upon such a flat surface It will also be noted that the lower surface 30 of each outer handle element 25 and the lower surface 31 of the central handle element 24 are all disposed in substantially coplanar relation with respect to each other.

Figure 4:
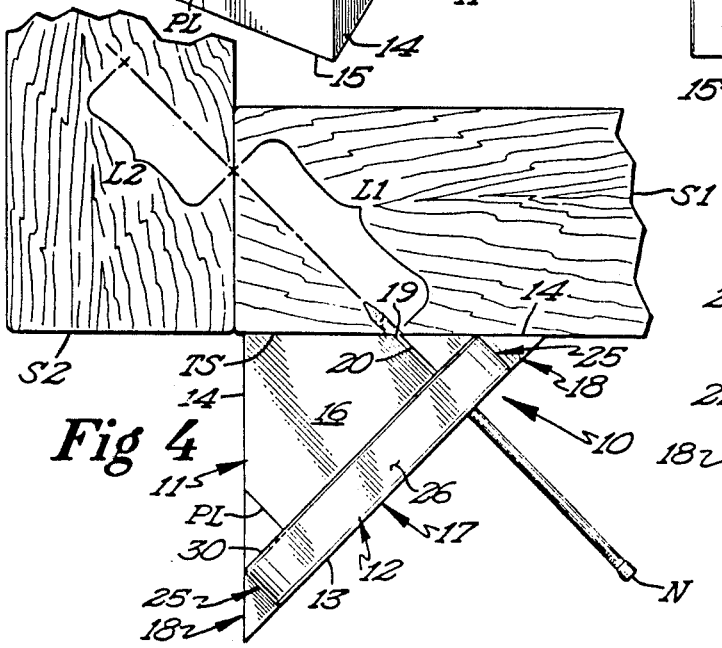
FIG. 4 is an elevational view of the tool and a cross-sectional view of a right-angled stud joint, illustrating the positioning of a nail which has been driven into the stud joint.

In use, the nail holder and toe-in tool 10 is used to accurately position a nail at the correct toe-in angle in a right angular stud joint, such as that illustrated in FIG. 4. In FIG. 4, it will be seen that a pair of studs S1 and S2 are disposed at right angles with respect to each other and these studs will be rigidly secured together by a nail N driven at a 45-degree angle with respect to a toe in surface TS of one of the studs. The tool 10 is positioned so that each leg surface 14 engages one of the surfaces of each stud S1, S2. A nail N is positioned in the opening 23 in the head 11, as shown in FIG. 4. In this regard, the nail N will penetrate the toe-in surface TS of the stud S1 one-inch from the joint so that the nail will be driven inwardly at a 45-degree angle.

After the nail is properly positioned within the opening, the user will drive the nail into the stud S1 ¼ inch and will thereafter remove the tool 10 from its engaging relation with respect to the nail. In this regard, the tool 10 will be moved outwardly away from the stud joint and one of the outer handle elements 25 will be shifted laterally outwardly to thereby shift the associated outer section away from the central section and allow the tool head to pass the partially driven in nail. When a 10-penny nail is used, 60% of the nail's length L1 will penetrate the stud S1 and 40% of the nail's length L2 will penetrate the stud S2. When a 10-penny nail is used to form a right angle stud joint, the length of the 10-penny nail, which is driven in at a 45-degree toe-in angle, will penetrate each stud S1, S2 equally.

The tool holder 10 may also be used to hold the nail N when the nail N is driven perpendicularly into a wooden stud or member. In this regard, the tool holder 10 may be positioned so that the base surface 13 engages the surface of the stud or member into which the nail is to be driven. The nail N may be then inserted into an opening 23, as illustrated in FIG. 1, and partially driven into the stud or member before an outer section is shifted laterally from the central section to permit removal of the tool from engaging relation with the nail.

From the foregoing, it will be seen that I have provided a novel nail holder and toe-in tool, which is not only of simple and inexpensive construction, but one which functions in a more efficient manner than any heretofore known comparable tool.

What is claimed is:

1. A hand-held nail holder toe-in tool comprising:

elongate handle means, a sectional triangular-shaped nail holding head rigidly secured to said handle and including a pair of flat leg surfaces and a flat base surface, the included angle between said leg surfaces being 90 degrees, and the included angle between each leg surface and base surface being 45 degrees, said sectional triangular head including a central section and a pair of outer sections, each outer section being normally disposed in abutting relation with said central section, the abutting surfaces between each outer section and the central section having mating grooves thereon, whereby a pair of openings is defined in the sectional head, each extending from one of the leg surfaces through said base surface, each opening having a cross-sectional size for accommodating conventional nails therethrough, the axis of each opening being disposed substantially normal to the plane of the base surface of said triangular-shaped head, said tool being operable to accurately position a nail at a 45-degree angle when the tool is positioned to dispose the tool head in engaging relation with a right angular stud joint whereby the tool head may be withdrawn after a nail extending through an opening in the tool head is partially driven into the right angular stud joint, and an outer head section is shifted laterally away from the central head section by a user manipulating said handle means.

2. The tool as defined in claim 1 wherein each of said outer head sections has a configuration of a 45-degree right triangle.

3. The tool as defined in claim 1 wherein said handle means includes an elongate central handle element and a pair of outer handle elements, said central handle element being secured at its front end to said central head section, each of said outer handle sections being secured at its front end to one of said outer sections, and means rigidly securing said handle sections together at their rear end portions.

4. A hand-held nail holder toe-in tool comprising:

an elongate handle, a sectional triangular-shaped nail holding head rigidly secured to said handle and including a pair of flat leg surfaces and a flat base surface, the included angle between said leg surfaces being 90 degrees, and the included angle between each leg surface and base surface being 45 degrees, said sectional triangular head including a central section and a pair of outer sections, each outer section having a flat inner surface disposed in confronting mating relation with one of a pair of flat outer surfaces of said central section, each outer section including a portion of one of said leg surfaces and an outer portion of said base surface, said central section including the central portion of said base surface and a portion of each leg surface, the inner surface of each outer section having a groove therein, and each outer surface of the central section having a groove therein disposed in opposed mating relation with the groove in an outer section to define a pair of openings through the triangular head, each extending from one of the leg surfaces through said base surface, each opening having a cross-sectional size for accommodating conventional nails therethrough, the axis of each opening being disposed substantially normal to the plane of the base surface of said triangular-shaped head, said handle including a central handle element secured to said central head section, and a pair of outer handle elements each being secured to one of said outer head sections, said handle elements being secured together, said outer handle elements being capable of limited lateral movement for moving the associated outer head section, said tool being operable to accurately position a nail at a 45-degree angle when the tool is disposed to position the tool head in engaging relation with a right angular stud joint whereby the tool head may be withdrawn after a nail extending through an opening in the tool head is partially driven into the right angular stud joint and an outer head section is shifted laterally away from the central head section by a user manipulating an outer handle element.

5. The tool as defined in claim 4 wherein said outer head sections each have the configuration of a 45-degree right triangle.

6. The tool as defined in claim 4 wherein said handle elements are rigidly secured together at their respective rear end portions.

* * * * *